US009463947B2

(12) United States Patent
Tahara

(10) Patent No.: US 9,463,947 B2
(45) Date of Patent: Oct. 11, 2016

(54) SHEET DISCHARGING DEVICE FOR ACCOMMODATING SHEETS OF DIFFERENT WIDTHS AND IMAGE FORMING APPARATUS PROVIDED WITH SAME

(71) Applicant: KYOCERA Document Solutions Inc., Osaka-shi, Osaka (JP)

(72) Inventor: Mitsuhiro Tahara, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/834,807

(22) Filed: Aug. 25, 2015

(65) Prior Publication Data

US 2016/0060071 A1 Mar. 3, 2016

(30) Foreign Application Priority Data

Aug. 28, 2014 (JP) ..... 2014-173436

(51) Int. Cl.
*B65H 43/06* (2006.01)
*B65H 29/70* (2006.01)
*B65H 29/14* (2006.01)

(52) U.S. Cl.
CPC ..... *B65H 43/06* (2013.01); *B65H 29/14* (2013.01); *B65H 29/70* (2013.01); *B65H 2301/51214* (2013.01); *B65H 2404/63* (2013.01); *B65H 2404/632* (2013.01); *B65H 2511/12* (2013.01); *B65H 2511/20* (2013.01); *B65H 2553/612* (2013.01); *B65H 2801/06* (2013.01); *G03G 2215/00911* (2013.01)

(58) Field of Classification Search
CPC ..... G03G 15/6552; G03G 15/6576; G03G 2215/00911; B65H 43/06
USPC ..... 399/405, 406
See application file for complete search history.

(56) References Cited

U.S. PATENT DOCUMENTS

2007/0002089 A1* 1/2007 Kobayashi
2008/0044214 A1* 2/2008 Nakajima ..... G03G 15/6576 399/406

FOREIGN PATENT DOCUMENTS

JP 4-85264 3/1992
JP 10120295 A * 5/1998
JP 2012111564 A * 6/2012

* cited by examiner

*Primary Examiner* — Walter L Lindsay, Jr.
*Assistant Examiner* — Milton Gonzalez
(74) *Attorney, Agent, or Firm* — Gerald E. Hespos; Michael J. Porco; Matthew T. Hespos

(57) ABSTRACT

A sheet discharging device includes a sheet discharge roller pair, a sheet discharge tray, a first actuator, a second actuator and a detector. The first actuator includes a first shaft portion and a first contact piece. The second actuator includes a second shaft portion, a second contact piece and a third contact piece. The detector detects the discharge of the sheet by the rotation of the second actuator about the second shaft portion. The leading end of a first sheet comes into contact with the first, second and third contact pieces to rotate the first and second actuators and the detector detects the discharge of the first sheet. The leading end of a second sheet comes into contact with only the third contact piece to rotate the second actuator without rotating the first actuator and the detector detects the discharge of the second sheet smaller than the first sheet.

9 Claims, 7 Drawing Sheets

SHEET DISCHARGING DEVICE FOR ACCOMMODATING SHEETS OF DIFFERENT WIDTHS AND IMAGE FORMING APPARATUS PROVIDED WITH SAME

This application is based on Japanese Patent Application No. 2014-173436 filed with the Japan Patent Office on Aug. 28, 2014, the contents of which are hereby incorporated by reference.

BACKGROUND

The present disclosure relates to a sheet discharging device and an image forming apparatus provided with the same.

Conventionally, a sheet discharging device provided in an image forming apparatus is known as a sheet discharging device for discharging sheets. The sheet discharging device includes discharge rollers, a discharging unit and an actuator. A sheet is discharged by the discharge rollers and stacked on a sheet discharge tray. The actuator is rotatable about a rotary shaft of the discharge roller and detects a fully stacked state of sheets when the height of the sheets stacked on the sheet discharge tray reaches a predetermined height.

SUMMARY

A sheet discharging device according to one aspect of the present disclosure includes a housing with a sheet discharge port, a sheet discharge roller pair, a sheet discharge tray, a first actuator, a second actuator and a detector. The sheet discharge roller pair is arranged in the sheet discharge port and discharges a sheet in a predetermined discharging direction. The sheet discharged by the sheet discharge roller pair is stacked on the sheet discharge tray. The first actuator is provided in the sheet discharge port. The first actuator includes a first shaft portion and a first contact piece. The first shaft portion extends in a sheet width direction intersecting with the discharging direction. The first contact piece projects from the first shaft portion on one end side in the sheet width direction. The first actuator is supported in the housing rotatably about the first shaft portion. The second actuator is provided in the sheet discharge port. The second actuator includes a second shaft portion, a second contact piece and a third contact piece. The second shaft portion extends on the other end side in the sheet width direction on the same axis as the first shaft portion. The second contact piece projects from the second shaft portion on the other end side in the sheet width direction. The third contact piece projects from the second shaft portion between the first and second contact pieces in the sheet width direction. The second actuator is supported in the housing rotatably about the second shaft portion. The detector detects the discharge of the sheet by the rotation of the second actuator about the second shaft portion. The leading end of a first sheet comes into contact with the first, second and third contact pieces to rotate the first and second actuators and the detector detects the discharge of the first sheet when the first sheet having a first sheet width is discharged from the sheet discharge port. The leading end of a second sheet comes into contact with only the third contact piece to rotate the second actuator without rotating the first actuator and the detector detects the discharge of the second sheet when the second sheet having a second sheet width smaller than the first sheet width is discharged from the sheet discharge port.

Further, an image forming apparatus according to another aspect of the present disclosure includes an image forming unit and the above sheet discharging device. The image forming unit forms an image on a sheet.

DETAILED DESCRIPTION

Figure 1:
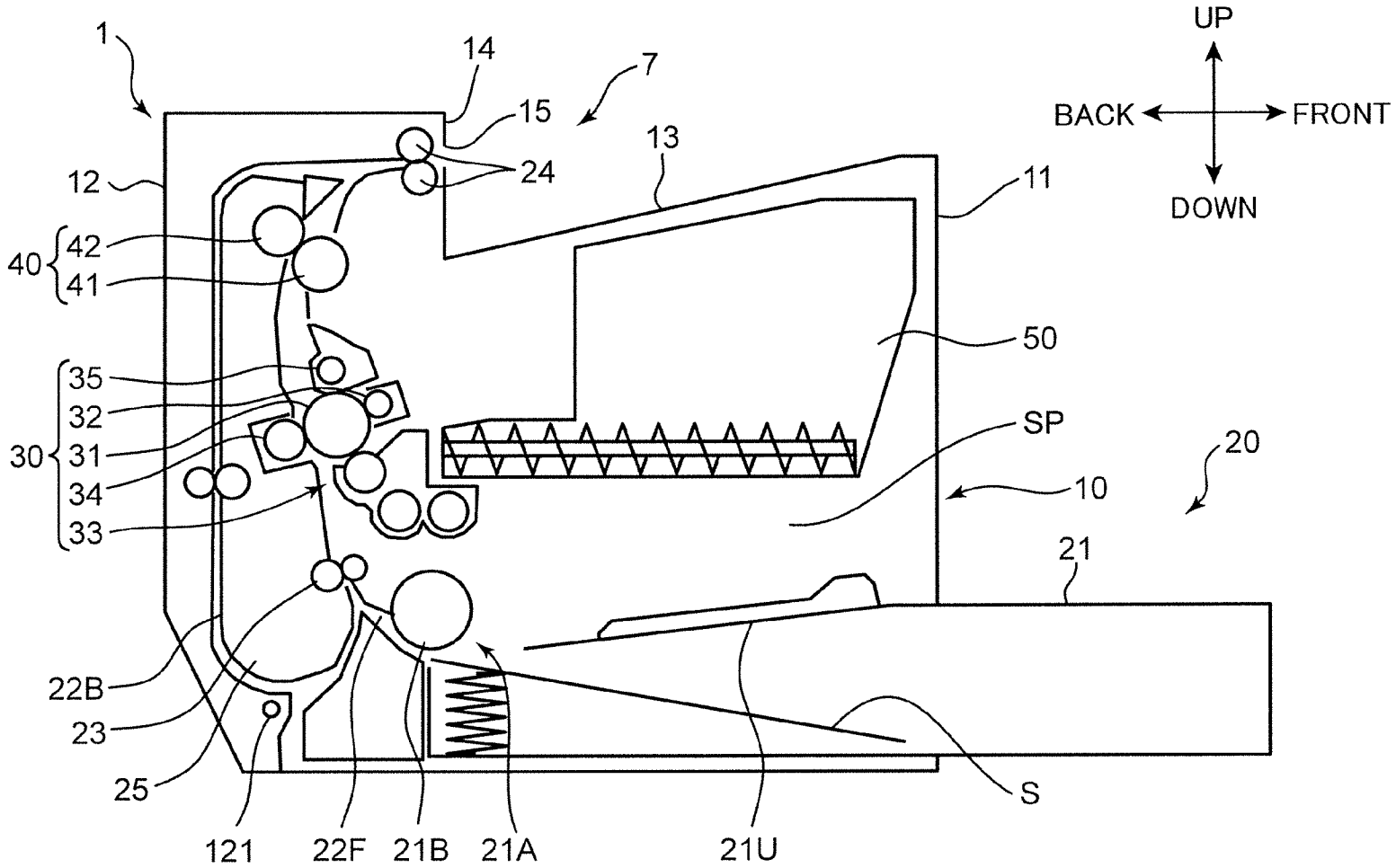
FIG. 1 is a sectional view showing the internal structure of an image forming apparatus according to one embodiment of the present disclosure.

Hereinafter, an embodiment of the present disclosure is described with reference to the drawings. FIG. 1 is a sectional view showing the internal structure of an image forming apparatus 1 according to one embodiment of the present disclosure. Although a monochrome printer is illustrated as the image forming apparatus 1 here, the image forming apparatus may be a copier, a facsimile machine or a complex machine provided with these functions or may be an image forming apparatus for forming a color image.

The image forming apparatus 1 includes a main body housing 10 having a substantially rectangular parallelepipedic housing structure, a sheet feeding unit 20, an image forming unit 30, a fixing unit 40 and a toner container 50 housed in this main body housing 10, and a sheet discharging device 7.

A front cover 11 and a rear cover 12 are respectively provided on a front surface side and a rear surface side of the main body housing 10. Further, a sheet discharge tray 13 to which sheets S are to be discharged is provided on the upper surface of the main body housing 10. Various devices for performing image formation are housed in an inner space SP (FIG. 2) defined by the front cover 11, the rear cover 12 and the sheet discharge tray 13.

The sheet feeding unit 20 includes a sheet cassette 21 for storing sheets S to which an image forming process is applied. The upper surface of a part of the sheet cassette housed in the main body housing 10 is covered with a sheet cassette ceiling plate 21U. The sheet cassette 21 is provided with a sheet storage space in which a stack of sheets is stored, an unillustrated lift plate which lifts up the stack of sheets for sheet feeding, and the like. A sheet pickup unit 21A is provided above a rear end side of the sheet cassette 21. A feed roller 21B for feeding the uppermost sheet of the sheet stack in the sheet cassette 21 one by one is arranged in this sheet pickup unit 21A.

The image forming unit 30 performs the image forming process of forming a toner image on a sheet fed from the sheet feeding unit 20. The image forming unit 30 includes a photoconductive drum 31 and a charging device 32, an exposure device (not shown in FIG. 2), a developing device 33, a transfer roller 34 and a cleaning device 35 arranged around this photoconductive drum 31.

A main conveyance path 22F and a reverse conveyance path 22B are provided to convey a sheet in the main body housing 10. The main conveyance path 22F extends from the sheet pickup unit 21A of the sheet feeding unit 20 to a sheet discharge port 15 provided to face the sheet discharge tray 13 on the upper surface of the main body housing 10 by way of the image forming unit 30 and the rollers 41 and 42 of the fixing unit 40. The reverse conveyance path 22B is a conveyance path for returning a sheet printed on one side to a side of the main conveyance path 22F upstream of the image forming unit 30 in the case of printing both sides of the sheet.

Further, a pair of registration rollers 23 are arranged on a side of the main conveyance path 22F upstream of a transfer nip portion. A sheet is fed to the transfer nip portion at a predetermined timing for image transfer after being temporarily stopped at the pair of registration rollers 23 and skew-corrected. A plurality of conveyor rollers for conveying a sheet are arranged at suitable positions of the main conveyance path 22F and the reverse conveyance path 22B.

The reverse conveyance path 22B is formed between an outer side surface of a reversing unit 25 and an inner surface of the rear cover 12 of the main body housing 10. Each of the rear cover 12 and the reversing unit 25 is rotatable about an axis of a supporting point portion 121 provided on the lower end thereof.

Figure 2:
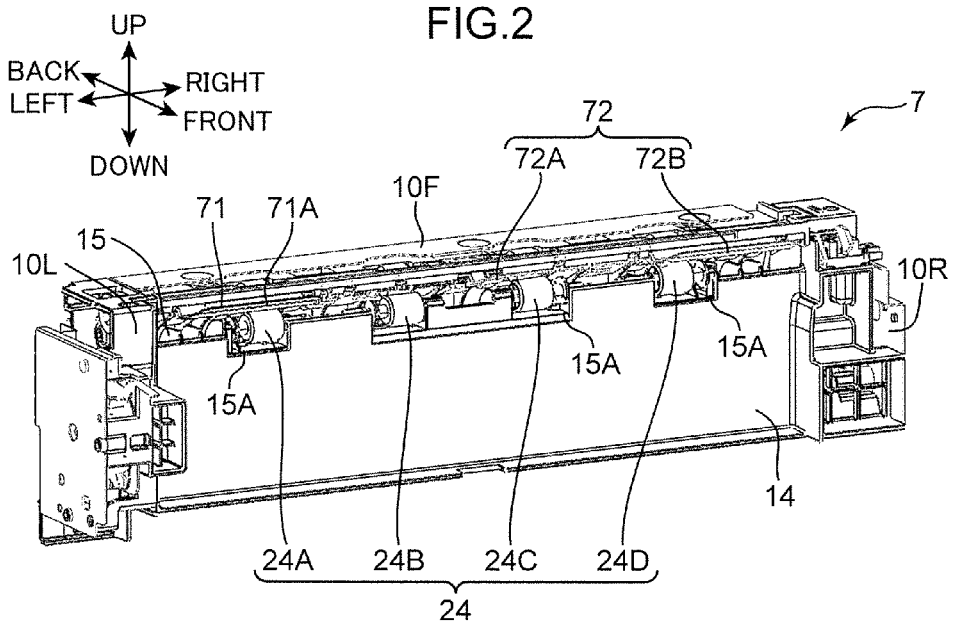
FIG. 2 is a perspective view of a part of a sheet discharging device according to the one embodiment of the present disclosure.
Figure 3:
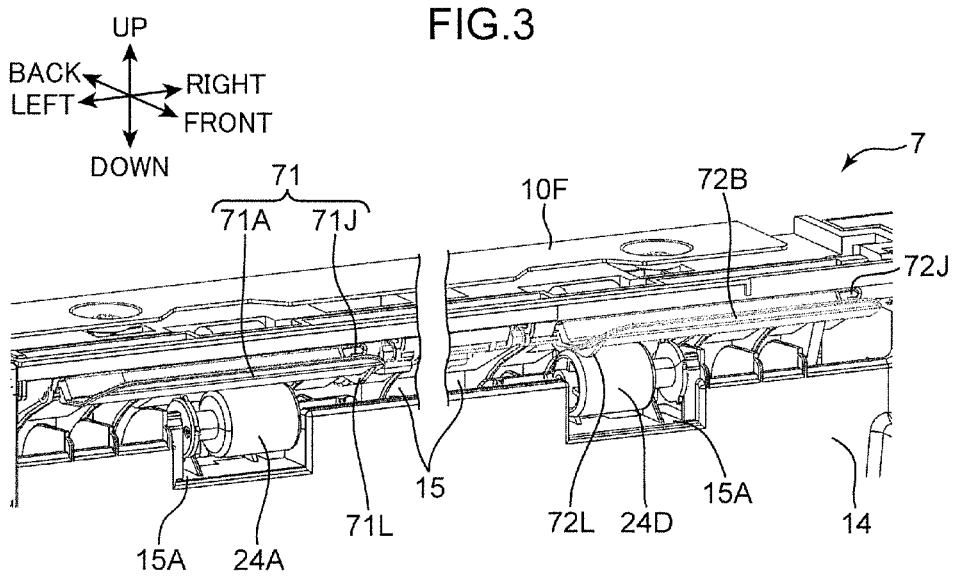
FIG. 3 is an enlarged perspective view enlargedly showing a part of the sheet discharging device of FIG. 2.

The sheet discharging device 7 is arranged on a downstream end part of the main conveyance path 22F. The sheet discharging device 7 discharges a sheet S to the sheet discharge tray 13. Next, the sheet discharging device 7 according to this embodiment is described in detail with reference to FIGS. 2 and 3. FIG. 2 is a perspective view of a part of the sheet discharging device 7 according to this embodiment. FIG. 3 is an enlarged perspective view enlargedly showing a part of the sheet discharging device of FIG. 2. Note that a left end side and a right end side of the sheet discharging device 7 are partly shown in FIG. 3.

The sheet discharging device 7 includes an upper frame 10F (housing), sheet discharge roller pairs 24, a first actuator 71, a second actuator 72 and a detector 80 (FIG. 9) in addition to the aforementioned sheet discharge tray 13 and sheet discharge port 15. Note that the sheet discharging device 7 is partly shown and the sheet discharge tray 13 is not shown in FIGS. 2, 3 and 4 to 6 to be described later. The upper frame 10F is a frame which is a part of the main body housing 10 and extends in a lateral direction on an upper surface part of the main body housing 10. A downstream end side of the main conveyance path 22F in a conveying direction extends in the upper frame 10F. The upper frame 10F is supported on a right wall 10R and a left wall 10L which are left and right side walls of the main body housing 10.

Further, the upper frame 10F includes a standing wall 14. The standing wall 14 is a wall portion standing to extend in vertical and lateral directions on a front side of the upper frame 10F. The rear end edge of a sheet stack of sheets S discharged to the sheet discharge tray 13 is in contact with the standing wall 14.

The sheet discharge port 15 is an opening open on an upper end part of the standing wall 14. The sheet discharge port 15 is formed into a narrow and long shape to extend in the lateral direction (sheet width direction). Sheets S are discharged from the sheet discharge port 15. Further, the upper end portion of the standing wall 14 defining a lower end part of the sheet discharge port 15 are partly cut to form a plurality of cut portions 15A as shown in FIG. 2.

The sheet discharge roller pairs 24 are roller pairs arranged in the sheet discharge port 15. The sheet discharge roller pairs 24 include a first sheet discharge roller pair 24A, a second sheet discharge roller pair 24B, a third sheet discharge roller pair 24C and a fourth sheet discharge roller pair 24D. These roller pairs are arranged while being spaced apart in the lateral direction and respectively arranged to face the aforementioned cut portions 15A. Note that, in FIG. 2, a driven roller located below out of each roller pair is shown. The sheet discharge roller pairs 24 discharge the sheet S forward (predetermined discharging direction). Further, the sheet S discharged by the sheet discharge roller pairs 24 is stacked on the aforementioned sheet discharge tray 13. A lower end part (rear end part) of the sheet discharge tray 13 formed to be inclined downwardly toward the back is coupled to the standing wall 14 (FIG. 1).

The first actuator 71 (FIG. 3) is arranged to face the sheet discharge port 15 and in contact with the sheet S discharged from the sheet discharge port 15. The first actuator 71 is arranged on one end side (left side) in the sheet width direction (lateral direction) intersecting with the conveying direction of the sheet S. The first actuator 71 includes a first shaft portion 71J and a left contact piece 71A (first contact piece, pressing member). The first shaft portion 71J is a shaft portion provided in the sheet discharge port 15 and extending on one end side in the lateral direction (sheet width direction). The first shaft portion 71J is rotatably supported on a pair of bearing portions 71K (FIG. 7) arranged in the upper frame 10F. The left contact piece 71A is a plate-like projecting piece projecting from the one end side of the first shaft portion 71J. As shown in FIG. 2, the left contact piece 71A is arranged to have a predetermined width in the sheet width direction above the first sheet discharge roller pair 24A. The first actuator 71 is supported in the upper frame 10F rotatably about the first shaft portion 71J.

The second actuator 72 is arranged to face the sheet discharge port 15 and in contact with the sheet S discharged from the sheet discharge port 15 similarly to the first actuator 71. The second actuator 72 is arranged on the other end side (right side) in the sheet width direction. The second actuator 72 includes a second shaft portion 72J (FIG. 3), a center contact piece 72A (third contact piece) and a right contact piece 72B (second contact piece, pressing member). The second shaft portion 72J is a shaft portion extending the other end side in the lateral direction (sheet width direction) on the same axis as the first shaft portion 71J. The second shaft portion 72J is rotatably supported on unillustrated bearing portions arranged in the upper frame 10F. The center contact piece 72A is a narrow and long projecting piece projecting from a left end part (the one end side) of the second shaft portion 72J. As shown in FIG. 2, the center contact piece 72A is arranged above between the second and third sheet discharge roller pairs 24B, 24C. The right contact piece 72B is a plate-like projecting piece projecting from a right end part (the other end side) of the second shaft portion 72J. As shown in FIG. 2, the right contact piece 72B is arranged to have a predetermined width in the sheet width direction above the fourth sheet discharge roller pair 24D. Note that a projection amount of the center contact piece 72A is equal to those of the left and right contact pieces 71A, 72B, but the center contact piece 72A is set to be narrower in the sheet width direction than the left and right contact pieces 71A, 72B. The second actuator 72 is supported in the upper frame 10F rotatably about the second shaft portion 72J.

Note that an unillustrated coil spring (biasing member) is arranged on each of the first and second shaft portions 71J, 72J. The coil springs bias the first and second actuators 71, 72 downwardly about the first and second shaft portions 71J, 72J so that the left, center and right contact pieces 71A, 72A and 72B are in contact with the sheet S discharged from the sheet discharge port 15.

In other words, the sheet discharging device 7 includes three contact pieces (left, center and right contact pieces 71A, 72A, 72B) along the sheet width direction near the sheet discharge port 15 for the first and second actuators 71, 72. Out of these, the left contact piece 71A is provided in the first actuator 71 and the center and right contact pieces 72A, 72B are provided in the second actuator 72. The center contact piece 72A is arranged in a central part in the sheet width direction and the left and right contact pieces 71A, 72B are symmetrically arranged on opposite sides in the sheet width direction with respect to the center contact piece 72A.

Further, with reference to FIG. 3, the left contact piece 71A includes a first rib 71L. The first rib 71L is a rib projecting downward from a right end side (other end side in the sheet width direction) of the left contact piece 71A. Similarly, the right contact piece 72B includes a second rib 72L. The second rib 72L is a rib projecting downward from a left end side (one end side in the sheet width direction) of the right contact piece 72B.

The detector 80 (FIG. 9) detects the discharge of the sheet S by the rotation of the first actuator 71 about the first shaft portion 71J or the rotation of the second actuator 72 about the second shaft portion 72J.

Figure 4:
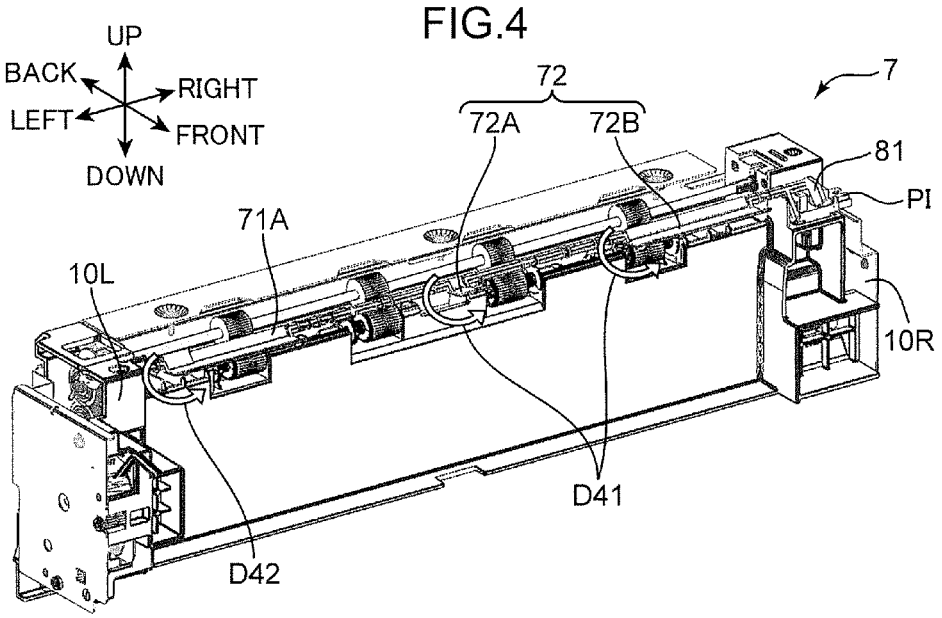
FIG. 4 is a perspective view of the part of the sheet discharging device when a first sheet is discharged.
Figure 5:
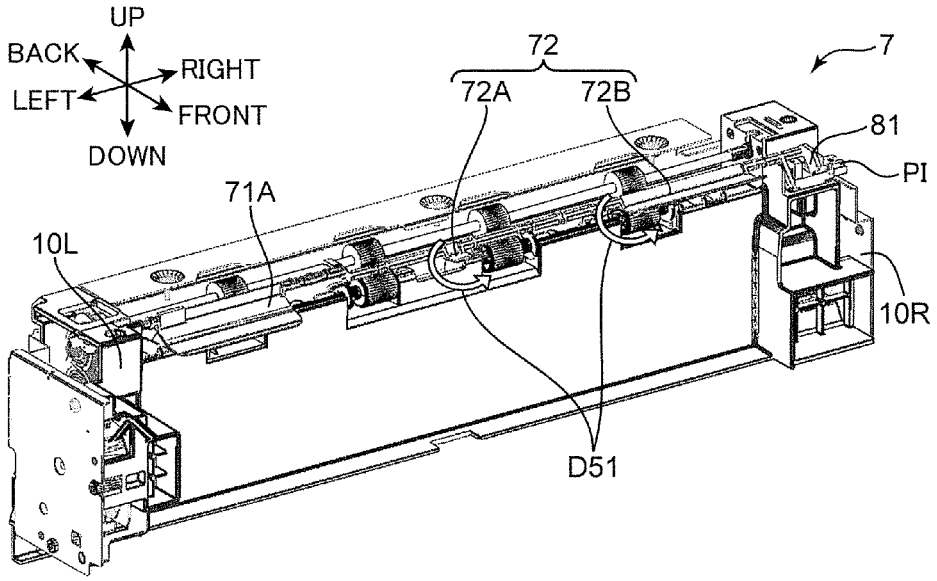
FIG. 5 is a perspective view of the part of the sheet discharging device when a second sheet is discharged.

FIG. 4 is a perspective view of the sheet discharging device 7 when a first sheet (not shown) is discharged. FIG. 5 is a perspective view of the sheet discharging device 7 when a second sheet (not shown) is discharged. The first sheet has a first sheet width and the second sheet has a second sheet width smaller than the first sheet width. The first and second sheets are both standard size sheets storable in the sheet cassette 21 (FIG. 1). In this embodiment, the first sheet is of an A3 size, B4 size, A4 size or A4R size (shorter sides of A4 size sheet extend in the sheet width direction) and the second sheet is of a B5R size, A5R size (shorter sides of A5 size sheet extend in the sheet width direction) or postcard size. Further, in this embodiment, these sheets are discharged with a center in the sheet width direction as a reference. In other words, the center of each sheet in the sheet width direction passes below the center contact piece 72A (see dashed-dotted line in FIG. 9).

With reference to FIG. 4, the first actuator 71 is rotated upwardly (arrow D42) and the second actuator 72 is rotated upwardly (arrow D41) by being pushed up by the first sheet in the case of discharging the first sheet from the sheet discharge port 15 (FIG. 3). As a result, the discharge of the first sheet is detected by the detector 80. On the other hand, with reference to FIG. 5, the second actuator 72 is rotated upwardly (arrow D51) by the center contact piece 72A being pushed up by the second sheet in the case of discharging the second sheet from the sheet discharge port 15. In this case, since the second sheet does not come into contact with the left contact piece 71A of the first actuator 71, the first actuator 71 is not rotated. However, only the second actuator 72 is rotated as described above, whereby the discharge of the second sheet is detected by the detector 80. Note that since each sheet is discharged with the center in the sheet width direction as a reference as described above, the second sheet does not come into contact with the right contact piece 72B, either. As just described, in this embodiment, a load applied from the first actuator 71 to press the second sheet is reduced when the second sheet having a small size is discharged. Thus, deterioration in the alignment of the second sheet when the second sheet is discharged to the sheet discharge tray 13 is suppressed.

Figure 6:
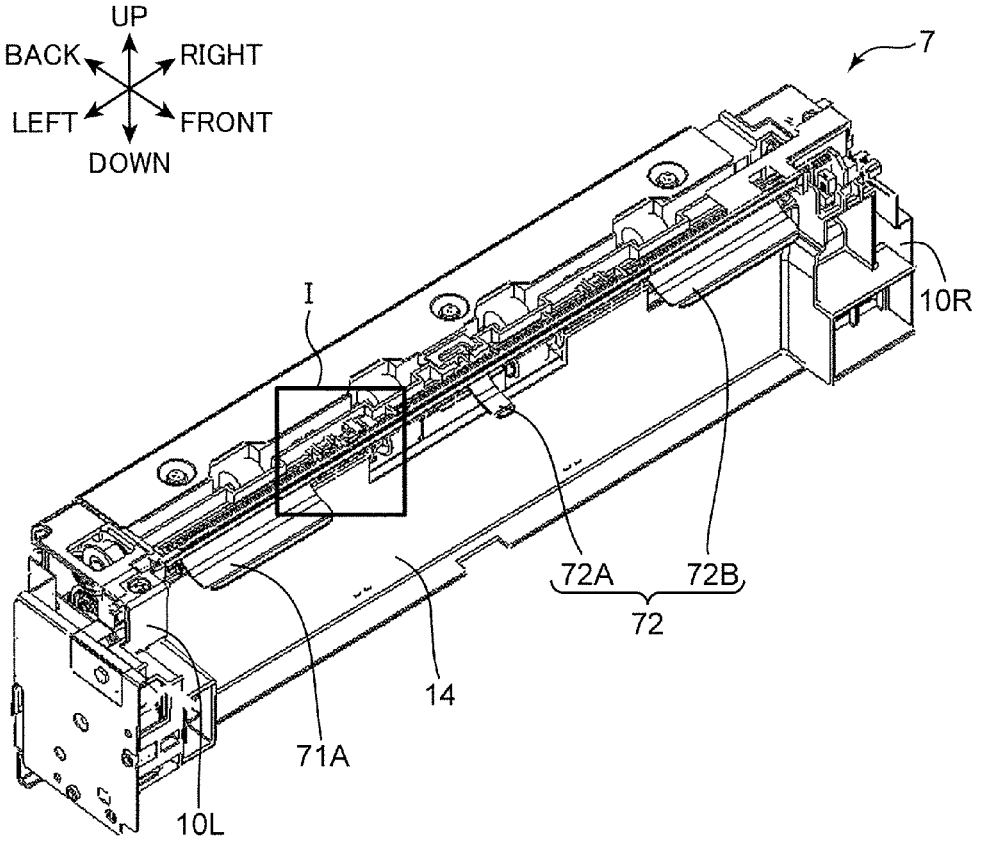
FIG. 6 is a perspective view of the part of the sheet discharging device according to the one embodiment of the present disclosure.
Figure 7:
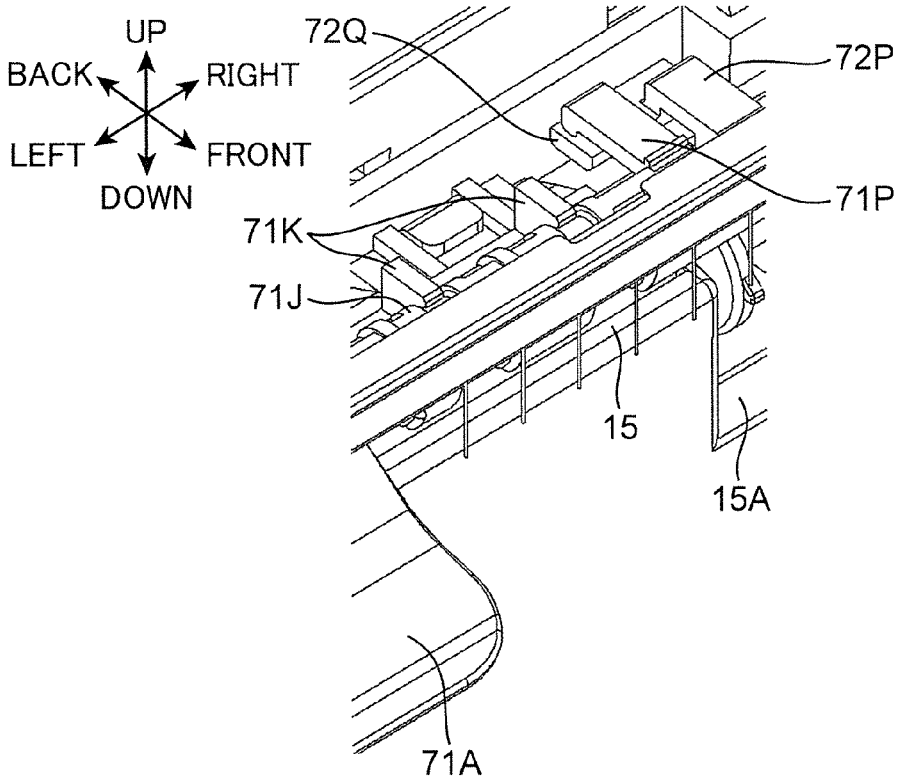
FIG. 7 is an enlarged perspective view enlargedly showing a part of the sheet discharging device of FIG. 6.
Figure 8:
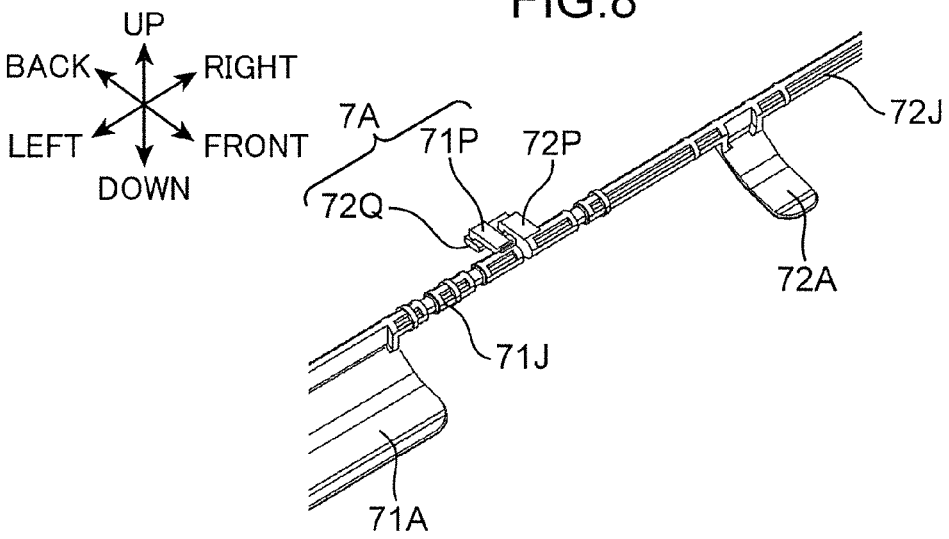
FIG. 8 is an enlarged perspective view showing parts of a first shaft portion and a second shaft portion according to the one embodiment of the present disclosure.
Figure 9:
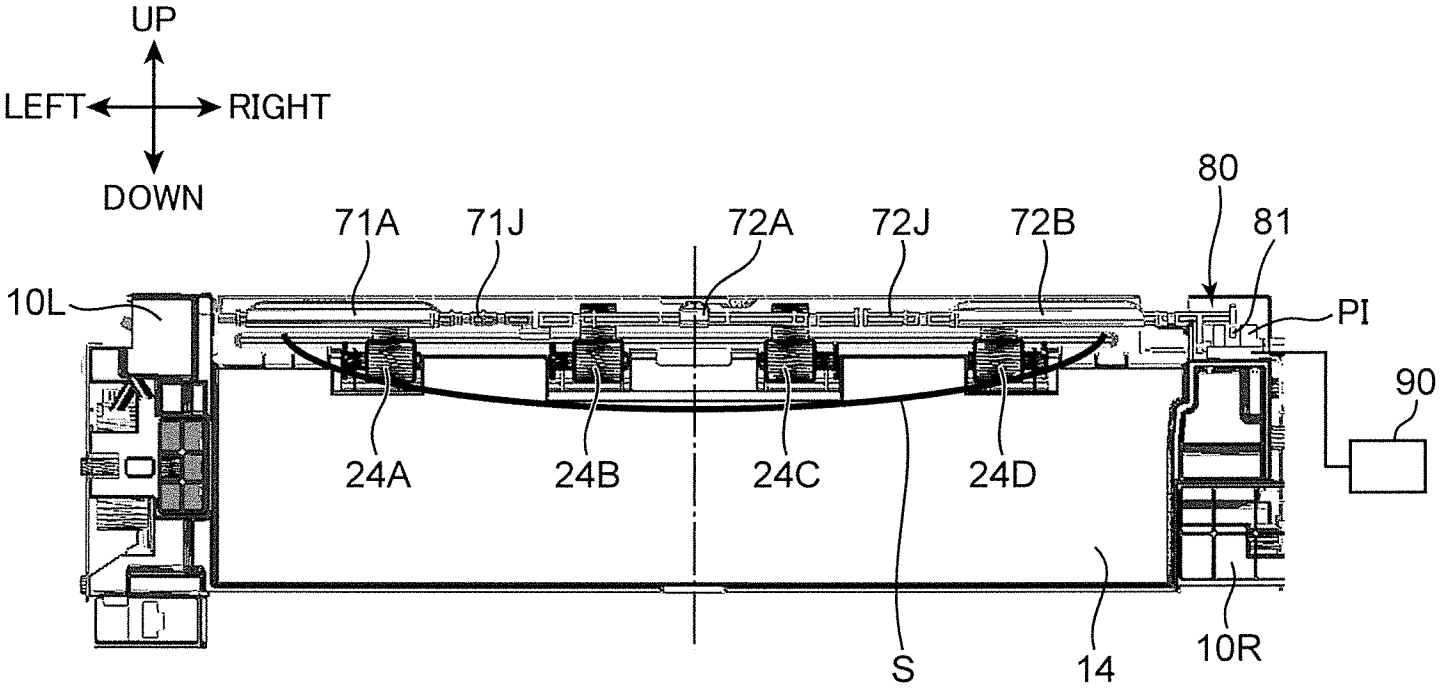
FIG. 9 is a front view showing a state where a curled sheet is discharged in the sheet discharging device according to the one embodiment of the present disclosure.

Next, the structures of the first actuator 71, the second actuator 72 and the detector 80 are described in more detail with reference to FIGS. 6 to 9. FIG. 6 is a perspective view of the sheet discharging device 7. FIG. 7 is an enlarged perspective view enlargedly showing a part (area I of FIG. 6) of the sheet discharging device 7 of FIG. 6. FIG. 8 is an enlarged perspective view showing parts of the first and second shaft portions 71J, 72J of the sheet discharging device 7. FIG. 9 is a front view showing a state where a curled sheet S is discharged in the sheet discharging device 7.

With reference to FIG. 8, the second shaft portion 72J is arranged on the same axis as the first shaft portion 71J at a right end side (other end side in the sheet width direction) of the first shaft portion 71J in this embodiment. Specifically, a right end part of the first shaft portion 71J and a left end part of the second shaft portion 72J are arranged to face each other. The first actuator 71 further includes a pressing piece 71P. The pressing piece 71P is a projecting piece projecting from the right end part of the first shaft portion 71J. As shown in FIG. 8, the pressing piece 71P projects from the first shaft portion 71J in a direction opposite to the left contact piece 71A. Further, the second actuator 72 includes a projection 72P. The projection 72P is a projecting piece projecting from the left end part of the second shaft portion 72J. As shown in FIG. 8, the projection 72P projects from the second shaft portion 72J in a direction opposite to the center contact piece 72A. Further, as shown in FIG. 7, the pressing piece 71P and the projection 72P are adjacently arranged in parallel to each other. Further, a pressed piece 72Q is provided on a tip part of the projection 72P. The pressed piece 72Q is a plate-like member fixed to the tip of the projection 72P and arranged to extend leftward (toward the pressing piece 71P) from the projection 72P. As a result, when no sheet is discharged, the pressed piece 72Q is arranged below the pressing piece 71P. With the rotation of the first actuator 71 about the first shaft portion 71J, the pressing piece 71P can press the pressed piece 72Q downwardly. As just described, in this embodiment, the pressing piece 71P and the pressed piece 72Q function as a coupling portion 7A (FIG. 8). The coupling portion 7A can couple the first and second shaft portions 71J, 72J. The coupling portion 7A couples the first and second shaft portions 71J, 72J and causes the first and second shaft portions 71J, 72J to integrally rotate in the case of discharging the first sheet. Further, the coupling portion 7A allows only the second shaft portion 72J to rotate with the rotation of the first shaft portion 71J stopped in the case of discharging the second sheet. Thus, a load applied to the second sheet is reduced as described later.

With reference to FIG. 9, the detector 80 includes a light blocking piece 81 (detecting piece), a photosensor PI (detection sensor) and a controller 90. The light blocking piece 81 is a projecting piece projecting in a radial direction in the rotation of the second actuator 72 from a tip part of the second shaft portion 72J extending further rightward than the right contact piece 72B. The photosensor PI is a sensor fixed to the right wall 10R to sandwich the light blocking piece 81. The photosensor PI includes unillustrated light emitter and light receiver. The photosensor PI can detect the rotation of the light blocking piece 81 about the second shaft portion 72J. When no sheet is discharged from the sheet discharge port 15, the light blocking piece 81 is arranged between the light emitter and the light receiver of the photosensor PI by a biasing force of the aforementioned coil spring to block detection light of the photosensor PI. The controller 90 receives an output signal of the photosensor PI and detects the discharge of the sheet S from the sheet discharge port 15.

With reference to FIGS. 4, 7 and 8, the leading end of the first sheet pushes the left, center and right contact pieces 71A, 72A and 72B upwardly when the first sheet is discharged from the sheet discharge port 15 (FIG. 3). When the left contact piece 71A is pushed upwardly, the first actuator 71 rotates about the first shaft portion 71J. At this time, the pressing piece 71P presses the pressed piece 72Q downwardly. Further, the center and right contact pieces 72A, 72B are also pushed upwardly by the first sheet. Thus, the second actuator 72 is rotated about the second shaft portion 72J and the light blocking piece 81 is separated from the photosensor PI. As a result, the controller 90 detects the discharge of the first sheet.

On the other hand, with reference to FIGS. 5, 7 and 8, the leading end of the second sheet comes into contact with the center contact piece 72A and pushes the center contact piece 72A upwardly when the second sheet is discharged from the sheet discharge port 15 (FIG. 3). Then, the second actuator 72 is rotated about the second shaft portion 72J and the light blocking piece 81 is separated from the photosensor PI. As a result, the controller 90 detects the discharge of the second sheet. At this time, since the second sheet does not come into contact with the left contact piece 71A, the pressing piece 71P (FIG. 7) is not in contact with the pressed piece 72Q. Thus, a load for only rotating the second actuator 72 is applied to the second sheet having a small size and the application of a load for rotating the first actuator 71 to the second sheet is suppressed. As just described, in this embodiment, the discharge of the sheet S is stably detected regardless of which of the first and second sheets is discharged.

Note that the width of the center contact piece 72A in the sheet width direction is set smaller than those of the left and right contact pieces 71A, 72B. Thus, the load applied to the second sheet when the second sheet is discharged can be reduced.

Figure 10:
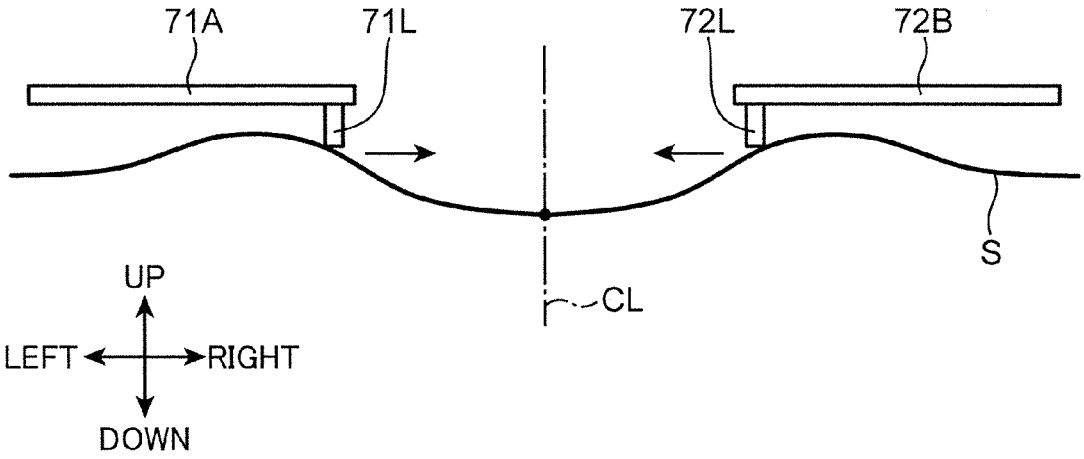
FIG. 10 is a schematic front view showing a state where a first rib and a second rib are in contact with a sheet.

Further, in this embodiment, the first and second ribs 71L, 72L are arranged as described above (FIG. 3). FIG. 10 is a schematic front view showing a state where the first and second ribs 71L, 72L are in contact with a sheet. Prior to the discharge of the sheet S from the sheet discharge port 15, a heating process is applied to the sheet S in the fixing unit 40. Thus, the sheet S tends to be discharged in a curled state (FIG. 9). At this time, as shown in FIG. 10, the first and second ribs 71L, 72L are in contact with a sheet surface of the sheet S (first sheet) discharged by the sheet discharge roller pairs 24. At this time, forces acting toward a middle point between the first and second ribs (center line CL) in the sheet width direction are applied to the sheet S as shown in FIG. 10. As a result, the sheet S is discharged while being regulated in the sheet width direction, wherefore the sheet S is better aligned on the sheet discharge tray 13. Further, the first and second ribs 71L, 72L are in contact with the sheet S to press the sheet S from above in this way, whereby the first and second actuators 71, 72 can be provided with a corrugation function of correcting a curl. Stiffness is applied to the sheet S by the first and second ribs 71L, 72L to correct the curl of the sheet S. At this time, the center contact piece 72A arranged in the central part in the sheet width direction has a function pf pressing a central part of the sheet S.

Further, the detector 80 may further detect a fully stacked state of sheets S on the sheet discharge tray 13. When the sheets S are fully stacked on the sheet discharge tray 13, the first and second actuators 71, 72 are kept rotated while being pressed by rear end parts of the stacked sheets S in a discharging direction. In this case, the controller 90 of the detector 80 can detect the fully stacked state of the sheets S on the sheet discharge tray 13 by detecting a continuously rotating state (rotation) of the first and second actuators 71, 72. Note that the fully stacked state on the sheet discharge tray 13 tends to be reached with a small number of sheets if the sheets S are curled. Thus, it is desirable to detect curled parts of the sheets S which tend to increase the height of the stacked sheets. In this embodiment, the left contact piece 71A of the first actuator 71 and the right contact piece 72B of the second actuator 72 are arranged on the opposite end sides in the sheet width direction. Thus, the left and right contact pieces 71A, 72B are pushed upwardly by easy-to-curl end parts of the sheets S in the sheet width direction. As a result, the fully stacked state of the curled sheets S on the sheet discharge tray 13 is rapidly detected by the detector 80. Further, since the rotation of the first actuator 71 is transmitted to the second actuator 72 as described above, the fully stacked state on the sheet discharge tray 13 can be detected even if only left end parts of the sheets S are curled. Specifically, the fully stacked state of the sheets S may be detected when the sheets S press either one of the first and second actuators 71, 72.

The sheet discharging device 7 and the image forming apparatus 1 provided with the same according to the embodiment of the present disclosure have been described above. According to such configurations, the sheets S to be discharged are better aligned in the sheet discharging device 7 capable of discharging sheets S having different sizes. Note that the present disclosure is not limited to this and, for example, the following modifications can be adopted.

Although the light blocking piece 81 is arranged on the second shaft portion 72J of the second actuator 72 in the above embodiment, the present disclosure is not limited to this. The detector 80 may include a specific shaft portion separately from the second shaft portion 72J and the light blocking piece 81 may be fixed to this shaft portion. In this case, the shaft portion of the detector 80 is arranged to extend in the sheet width direction up to an area where the pressing piece 71P and the projection 72P (FIG. 7) are arranged. Then, a pressed piece equivalent to the pressed piece 72Q of FIG. 7 may be arranged on the shaft portion of the detector 80. When the first or second actuator 71 or 72 rotates, the pressed piece is pressed, whereby the shaft portion of the detector 80 rotates. As a result, the rotation of the light blocking piece 81 is detected by the photosensor PI.

Further, although the sheet S is discharged with the center in the sheet width direction as a reference in the above embodiment, the present disclosure is not limited to this. The sheet S may be discharged with the right end side in the sheet width direction in FIG. 2 as a reference as a modification of the present disclosure. In this case, the right end edge of each sheet S is discharged to pass below the right contact piece 72B even if the sheets S have different widths.

When the first sheet having the first sheet width is discharged from the sheet discharge port 15, the leading end of the first sheet comes into contact with the left and right contact pieces 71A, 72B, whereby the first and second actuators 71, 72 are rotated and the controller 90 detects the discharge of the first sheet.

On the other hand, when the second sheet having the second sheet width is discharged from the sheet discharge port 15, the leading end of the second sheet comes into contact with only the right contact piece 72B, whereby the second actuator 72 is rotated without rotating the first actuator 71 and the controller 90 detects the discharge of the second sheet. Even in this case, a load for only rotating the second actuator 72 is applied to the second sheet having a small size and the application of a load for rotating the first actuator 71 to the second sheet is suppressed. Note that, in the case of the above modification, the second actuator 72 may not necessarily include the center contact piece 72A.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet discharging device, comprising:

a housing with a sheet discharge port;

a sheet discharge roller pair arranged in the sheet discharge port and configured to discharge a sheet in a predetermined discharging direction;

a sheet discharge tray configured such that the sheet discharged by the sheet discharge roller pair is stacked thereon;

a first actuator provided to face the sheet discharge port, including a first shaft portion extending on one end side in a sheet width direction intersecting with the discharging direction and a first contact piece projecting from the first shaft portion on the one end side in the sheet width direction, and supported in the housing rotatably about the first shaft portion;

a second actuator provided to face the sheet discharge port, including a second shaft portion extending on the other end side in the sheet width direction on the same axis as the first shaft portion, a second contact piece projecting from the second shaft portion on the other end side in the sheet width direction and a third contact piece projecting from the second shaft portion on the one end side in the sheet width direction, and supported in the housing rotatably about the second shaft portion;

a detector configured to detect the discharge of the sheet by the rotation of the second actuator about the second shaft portion, wherein:

the leading end of a first sheet comes into contact with the first, second and third contact pieces to rotate the first and second actuators and the detector detects the discharge of the first sheet when the first sheet having a first sheet width is discharged from the sheet discharge port; and the leading end of a second sheet comes into contact with only the third contact piece to rotate the second actuator without rotating the first actuator and the detector detects the discharge of the second sheet when the second sheet having a second sheet width smaller than the first sheet width is discharged from the sheet discharge port; and the sheet discharging device further comprising a coupling portion that couples the first and second shaft portions and causes the first and second shaft portions to rotate integrally when the first sheet is discharged and allows only the second shaft portion to rotate with the portion of the first shaft portion being stopped when the second sheet is discharged.

2. The sheet discharging device according to claim 1, wherein:

the first contact piece includes a first rib projecting downward from the other end side in the sheet width direction;

the second contact piece includes a second rib projecting downward from the one end side in the sheet width direction; and the first and second ribs are in contact with a sheet surface of the first sheet when the first sheet is discharged from the sheet discharge port.

3. The sheet discharging device according to claim 1, wherein:

the first and second contact pieces function as pressing members capable of correcting a curl of the sheet by pressing a sheet surface of the sheet downwardly from above.

4. The sheet discharging device according to claim 1, wherein:

the third contact piece is arranged in a central part in the sheet width direction and the first and second contact pieces are symmetrically arranged on opposite sides in the sheet width direction with respect to the third contact piece.

5. The sheet discharging device according to claim 1, wherein:

the coupling portion includes:

a pressing piece projecting from an end part of the first shaft portion on the other end side in the sheet width direction; and a pressed piece projecting from an end part of the second shaft portion on the one end side in the sheet width direction and pressable by the pressing piece with a rotation of the first shaft portion; and the detector includes;

a detecting piece projecting from an end part of the second shaft portion on the other end side in the sheet width direction; and a detection sensor capable of detecting the rotation of the detecting piece about the second shaft portion.

6. The sheet discharging device according to claim 1, wherein:

the first or second actuator rotates by a rear end part of the sheet stacked on the sheet discharge tray in the discharging direction pressing the first contact piece or the second and third contact pieces; and the detector detects a fully stacked state of the sheets on the sheet discharge tray by continuously detecting the rotation of the first or second actuator.

7. The sheet discharging device according to claim 1, wherein:

a width of the third contact piece in the sheet width direction is smaller than those of the first and second contact pieces in the sheet width direction.

8. An image forming apparatus, comprising:

an image forming unit configured to form an image on a sheet; and the sheet discharging device according to claim 1.

9. A sheet discharging device, comprising:

a housing with a sheet discharge port;

a sheet discharge roller pair arranged in the sheet discharge port and configured to discharge a sheet in a predetermined discharging direction;

a sheet discharge tray configured such that the sheet discharged by the sheet discharge roller pair is stacked thereon;

a first actuator provided in the sheet discharge port, including a first shaft portion extending in a sheet width direction intersecting with the discharging direction and a first contact piece projecting from the first shaft portion on one end side in the sheet width direction, and supported in the housing rotatably about the first shaft portion;

a second actuator provided in the sheet discharge port, including a second shaft portion extending on the other end side in the sheet width direction on the same axis as the first shaft portion and a second contact piece projecting from the second shaft portion on the other end side in the sheet width direction, and supported in the housing rotatably about the second shaft portion;

a detector configured to detect the discharge of the sheet by the rotation of the second actuator about the second shaft portion; wherein the leading end of a first sheet comes into contact with the first and second contact pieces to rotate the first and second actuators and the detector detects the discharge of the first sheet when the first sheet having a first sheet width is discharged from the sheet discharge port; and the leading end of a second sheet comes into contact with only the second contact piece to rotate the second actuator without rotating the first actuator and the detector detects the discharge of the second sheet when the second sheet having a second sheet width smaller than the first sheet width is discharged from the sheet discharge port; and the sheet discharging device further comprising a coupling portion that couples the first and second shaft portions and causes the first and second shaft portions to rotate integrally when the first sheet is discharged and allows only the second shaft portion to rotate with the rotation of the first shaft portion being stopped when the second sheet is discharged.

* * * * *